US007175689B2

(12) United States Patent
Dobesberger et al.

(10) Patent No.: US 7,175,689 B2
(45) Date of Patent: Feb. 13, 2007

(54) PROCESS FOR PRODUCING A LIGHTWEIGHT MOLDED PART AND MOLDED PART MADE OF METAL FOAM

(75) Inventors: Franz Dobesberger, Schwarzenau (AT); Herbert Flankl, Perg (AT); Dietmar Leitlmeier, Schleissheim/Wels (AT); Alois Birgmann, Moosdorf (AT); Peter Schulz, Simbach (DE)

(73) Assignee: Huette Klein-Reichenbach Gesellschaft mbH, Schwarzenau (AT)

( * ) Notice: Subject to any disclaimer, the term of this patent is extended or adjusted under 35 U.S.C. 154(b) by 609 days.

(21) Appl. No.: 10/170,684

(22) Filed: Jun. 14, 2002

(65) Prior Publication Data

US 2003/0005793 A1 Jan. 9, 2003

(30) Foreign Application Priority Data

Jun. 15, 2001 (AT) ..... 935/2001
Jun. 15, 2001 (AT) ..... 936/2001
Apr. 22, 2002 (AT) ..... 621/2002

(51) Int. Cl.
*B22B 27/00* (2006.01)

(52) U.S. Cl. ..... 75/415; 164/79; 164/55.1

(58) Field of Classification Search ..... 75/415; 164/79, 55.1

See application file for complete search history.

(56) References Cited

U.S. PATENT DOCUMENTS

| | | | |
|---|---|---|---|
| 4,973,358 | A | 11/1990 | Jin et al. |
| 5,112,697 | A | 5/1992 | Jin et al. |
| 5,186,886 | A | 2/1993 | Zerinvary et al. |
| 5,221,324 | A | 6/1993 | Jin et al. |
| 5,281,251 | A | 1/1994 | Kenny et al. |
| 5,334,236 | A | 8/1994 | Sang et al. |

FOREIGN PATENT DOCUMENTS

| | | |
|---|---|---|
| CA | 2147377 | 5/1994 |
| CA | 2378825 | 1/2001 |
| DE | 4326982 | 9/1995 |
| EP | 483184 | 5/1992 |
| EP | 544291 | 6/1993 |
| EP | 545957 | 8/1996 |
| JP | 2000-263194 | 9/2000 |
| WO | 9101387 | 2/1991 |
| WO | 9103578 | 3/1991 |

OTHER PUBLICATIONS

"ASM Handbook: vol. 15 Casting", ASM International, 1988, p. 323-326.*
English Translation Abstract of EP 0 544 291.
English Translation Abstract of DE 43 26 982.
English Language Abstract of JP 2000-263194.
Miyoshi T et al: "Aluminum foam, 'ALPORAS': the production process, properties and applications" Porous and Cellular Materials for Structural Applications Materials Research Society Symposium Proceedings V 521 1998, Materials Research Society, Pittsburg, PA, US, Bd. 521, 1998, pp. 133-137, ISSN: 0272-9172.
Nadler, J.H. (Georgia Inst of Technology, Atlanta, GA, USA) et al: "Aluminum hollow sphere processing." Materials Science Forum V 331 (1) 2000 p. 495-500 ISSN: 0255-5476.

* cited by examiner

*Primary Examiner*—George Wyszomierski
*Assistant Examiner*—Janelle Morillo
(74) *Attorney, Agent, or Firm*—Greenblum & Bernstein, P.L.C.

(57) ABSTRACT

A process for producing a lightweight molded part, comprising introducing a gas into a particle-containing, molten metal to produce a metal foam having voids with a monomodal distribution of their dimensions, introducing the metal foam into a casting die and compressing it therein essentially under all-round pressure; and the molded part made by this process.

17 Claims, 5 Drawing Sheets

A

B

A

B

C

A

B

C

PROCESS FOR PRODUCING A LIGHTWEIGHT MOLDED PART AND MOLDED PART MADE OF METAL FOAM

CROSS-REFERENCE TO RELATED APPLICATIONS

The present application claims priority under 35 U.S.C. §119 of Austrian Patent Application No. 935/2001, filed on Jun. 15, 2001, of Austrian Patent Application No. 936/2001, filed on Jun. 15, 2001, and of Austrian Patent Application No. 621/2002, filed on Apr. 22, 2002. The entire disclosures of these three applications are expressly incorporated herein by reference.

BACKGROUND OF THE INVENTION

1. Field of the Invention

The invention relates to a process for producing a lightweight molded part in which a metal foam is formed out of a particle-containing, molten metal by introducing gas or gas mixtures into the melt, the melt is introduced at least partially into a casting die, and the liquid phase is allowed to solidify therein.

The invention further comprises a lightweight molded part made of metal foam, comprising a metal matrix in which particles are embedded and which encloses a plurality of essentially spherical and/or essentially ellipsoid voids.

2. Discussion of Background Information

Molded parts made of metal foam naturally have a low density and, due to their structure, have special mechanical material properties. For instance, such parts can be given large deformations with upsetting degrees up to 70% and more with the application of two-or three-dimensional compressive strains. These materials with special properties can be advantageously used in technical applications, e.g., as energy absorbers in automotive technology and the like.

When using such molded parts for selected functions with certain parameters, it is important to ensure identical and reproducible property characteristics of the materials.

A process for producing a particle-reinforced metal foam is known from EP 483 184 B, the entire disclosure of which is expressly incorporated herein by reference. According to this document cellulating gas is introduced into a metal melt having reinforcing agents finely distributed therein, metal foam composite material is formed, and the accumulated foam is removed from the surface of the melted material and allowed to solidify. However, this metal foam has bubbles with uncontrolled size or size distribution, which results in a highly diffused property profile of the foam or molded part and causes functional uncertainties.

According to EP 545 957 B1 and U.S. Pat. No. 5,221,324, expressly incorporated herein by reference in their entireties, another lightweight metal part has a plurality of closed and isolated, generally spherical pores with sizes in range of 10 to 500 μm. Although such small pores with large differences in diameter can provide a metal part made with aluminum with a lower specific gravity in comparison with the bulk material, it usually is impossible to achieve a density of less than 1.0 g/cm$^3$ and an upsetting degree of more than 60% under defined conditions.

A number of sequentially operating (U.S. Pat. No. 5,281,251, DE 43 26 982 C1) and/or continuously operating (U.S. Pat. No. 5,334,236, EP 544 291 A1, DE 43 26 982 C1, WO 91/03578) processes and devices have been proposed for producing various shapes of lightweight parts made of metal foam, with which processes and devices articles which are quite operable on principle can be produced. However, the mechanical properties thereof cannot be adjusted with the precision which is often required. The entire disclosures of the above documents are expressly incorporated herein by reference.

SUMMARY OF THE INVENTION

The present invention provides a process of the type mentioned at the outset for producing a lightweight molded part with which the internal structure of the part can be developed such that the material essentially has precise mechanical characteristics.

Furthermore, the present invention provides a molded part of the type mentioned above which shows a largely precise deformation behavior as a function of, in particular, the multi-dimensional compressive strain applied.

According to the invention a free-flowing metal foam with a monomodal distribution of the dimensions of the voids and a proportionate maximum longitudinal extension thereof in the range of about 1 to about 30 mm is produced, introduced into a mold or casting die and compressed therein essentially under all-round pressure (i.e., pressure from all sides), wherein the particle-containing, molten metal boundary walls enclosing the voids are at least partially given planar areas and the heat of solidification of the melt is dissipated.

The advantages achieved with the invention can be seen essentially in that a monomodal distribution of the dimension of the voids in the metal foam establishes a prerequisite for a predetermined material behavior under certain strain conditions. In this context, the proportionate maximum diameter of the voids is important for the level of the elastic limit of the material and the tolerable specific surface strain during the subjecting of the part to compressive strain.

In order to at least partially create planar areas in the boundary walls, it is necessary to subject the free-flowing foam to an essentially all-round, optionally low, pressure, which can result in several advantages. However, the advantage of particular importance is that in this manner the boundary walls and their nodal areas in the foam material are favorably adapted or formed for a mechanical supporting or buckling load. This makes it possible, when exceeding a defined strain limit, to ensure that at high deformation or upsetting degrees, a buckling of the foam walls or a collapse of the pores and an energy absorption takes place with low compaction of the lightweight part.

It has proved to be particularly advantageous both for a monomodal distribution of the dimensions of the voids which can be produced within narrow limits and for a precise adjustment of the proportionate maximum diameter of the voids in the foam material, if the gas is introduced through at least one feed pipe with a small frontal area projecting inwardly into the melt to develop the monomodal distribution of the dimensions of the voids. Preferred devices and processes for producing the present metal foam and a part made therefrom are described in a concurrently filed U.S. application Ser. No. 10/170,538 in the names of Franz Dobesberger, Herbert Flankl, Dietmar Leitlmeier and Alois Birgmann and having the title "Device and Process for Producing Metal Foam", the disclosure of which is expressly incorporated herein by reference in its entirety.

For production-related and product quality reasons, it can be advantageous if the compression of the free-flowing metal foam is conducted in a casting die with interior dimensions which correspond to the desired dimensions of the molded part.

According to a particularly advantageous embodiment of the invention, particularly with regard to a desired material behavior during mechanical stress, in a three-dimensional view the metal foam of the molded part shows a monomodal distribution of the maximum longitudinal extensions of the voids in the range of between about 1 and about 30 mm.

The advantages of a lightweight molded part made in this way from metal foam are essentially due to the fact that as already indicated above, favorable conditions regarding the nodal development of the walls of the gas bubbles are achieved by means of a monomodality. With a bimodal, poly- or multi-modal distribution of the void size, thickened sections with possibly small and/or very small pores and cavity collapses are mostly present in the wall nodes, which on the one hand increases the specific gravity of the foam part and increases the metal resources for forming the same, and on the other hand can disturb the distribution of the force components, as a result of which a buckling of the wall area during strain cannot be definitely determined.

The invention's advantages of the impact of the working mechanisms in the component distribution of the compressive forces can be intensified, if the boundary walls enclosing the voids have planar areas at least in part.

If, as can be further provided in an advantageous way, in a three-dimensional view of the metal foam the ratio of the maximum longitudinal extensions of two different voids on the average is lower than about 45 for at least 20 examined pairs, narrow strain ranges within which a collapse of the foam voids begins can largely be achieved.

The precision of the transition from an elastic deformation to a plastic deformation of the material as a function of the compressive strain can be further increased if in a three-dimensional view of the metal foam the ratio of the maximum longitudinal extensions of two different voids over at least 20 pairs on the average is less than about 30, preferably less than about 15, and in particular less than about 5. These values refer to generated voids, disregarding solidification cavities in the molded part.

The composition and the structure of the liquid metal and those of the boundary walls of the voids also are important for a metal foam production and for the behavior of the molded part during mechanical stress.

If the reinforcing particles are embedded in the metal matrix in an evenly distributed fashion, a high and isotropic strengthening of the base metal can be obtained with regard to the mechanical stress. In this context it is also favorable if adjacent voids are completely separated from one another by the metal matrix. Individual cracks which can occur due to mechanical strain during cooling, are not effective under upsetting pressures.

Particularly lightweight molded parts can be produced according to the invention if the metal matrix comprises a light metal, preferably aluminum or an aluminum alloy.

If, moreover, the particles embedded in the metal matrix are of a size of about 1 to about 50 μm, preferably about 3 to about 20 μm, a particularly advantageous weight/property ratio can be achieved.

Inclusions of nonmetallic particles, preferably SiC particles and/or $Al_2O_3$ particles and/or such of intermetallic phases, have proved to be particularly favorable for reinforcing or strengthening the base metal for a foaming and consolidation of the same, and/or for developing bubble partition walls which are strengthened against buckling.

In this context it is particularly advantageous if the volume fraction of the particles embedded in the metal matrix is between about 10 vol % and about 50 vol %, preferably between about 15 vol % and about 30 vol %.

The favorable weight/property ratio of a lightweight molded part according to the present invention can be further improved if the density of the metal foam is less than about 1.05 g/cm$^3$, preferably less than about 0.7 g/cm$^3$, in particular less than about 0.3 g/cm$^3$.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
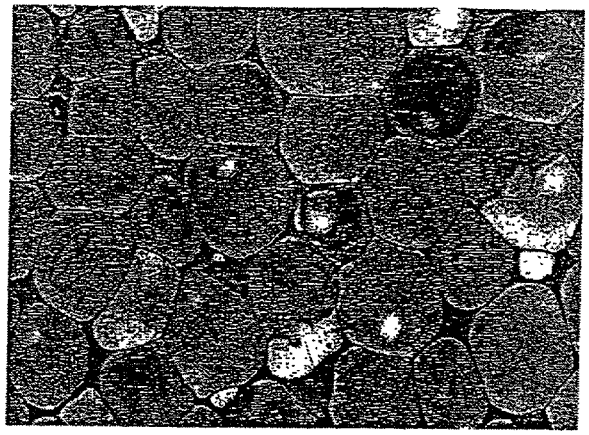
FIG. 1 shows sectional views of lightweight molded parts according to the invention.
Figure 1:
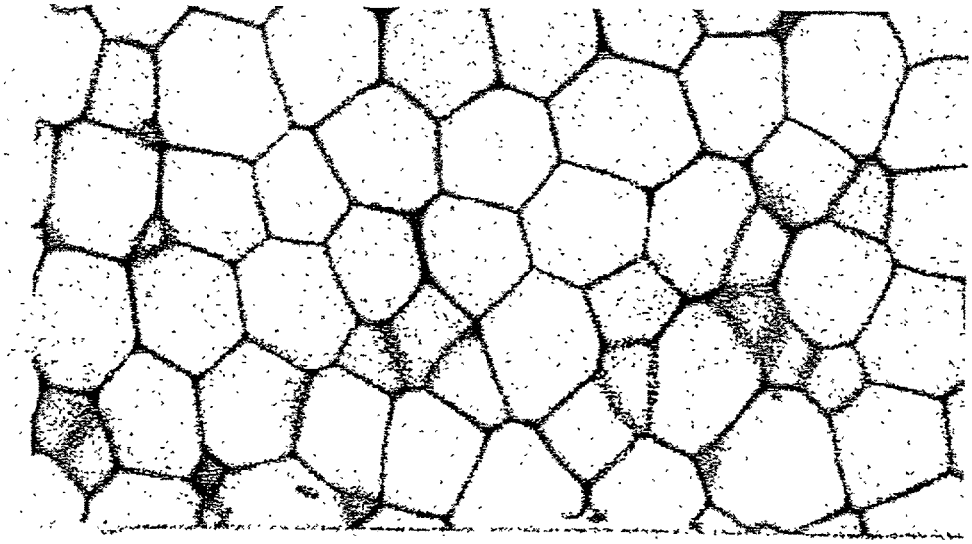

In FIG. 1, view A and view B each show a void formation in an Al shaped part according to the invention on the basis of a sectional view. With a monomodal distribution of the dimensions, the largest longitudinal extensions of voids were determined to be in the range of between 20 and 12 mm, with the proportionate maximum longitudinal extension being 17.2 mm. Although a compression of the free-flowing metal foam of only approx. 3.2% was conducted, planar areas are clearly formed in the boundary walls enclosing the voids.

Figure 2:
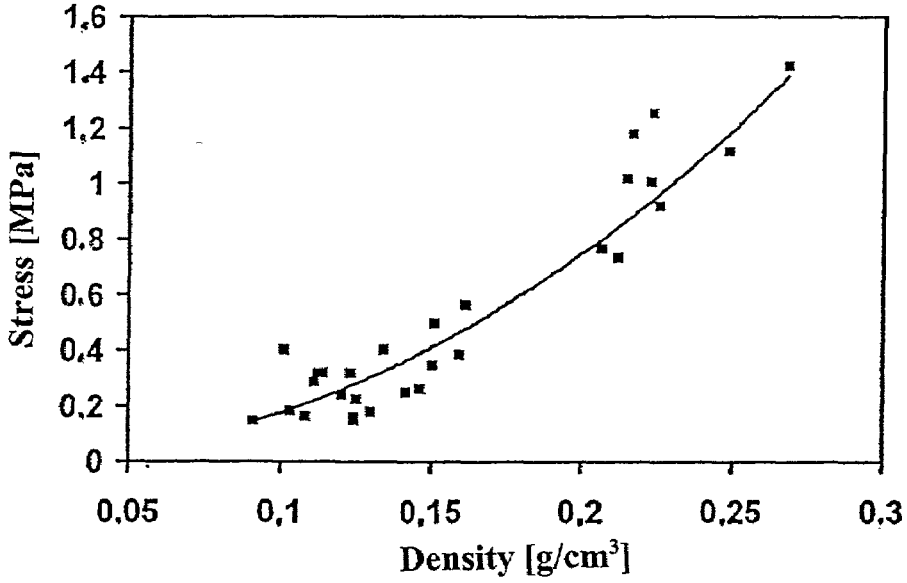
FIG. 2 is a graphic representation of the relationship between density and upsetting stress of molded parts.

The dependence of the upsetting stress of a molded part on the density of the same can be seen from FIG. 2. It was established during the development work that a monomodal distribution of the largest longitudinal extensions of the voids and an increasing uniformity of the same has a narrowing effect on the scatter band of the dependence. In other words: if there is a monomodal distribution of the voids in the foam part, and if the voids are of a certain size within narrow limits, the start of the deformation or collapse during exposure of the same to a compressive strain load is a precise characteristic of the material. The behavior of a foam component can thus be precisely calculated, or the formation and the structure of the foam part can advantageously be adjusted for certain functions.

Figure 3:
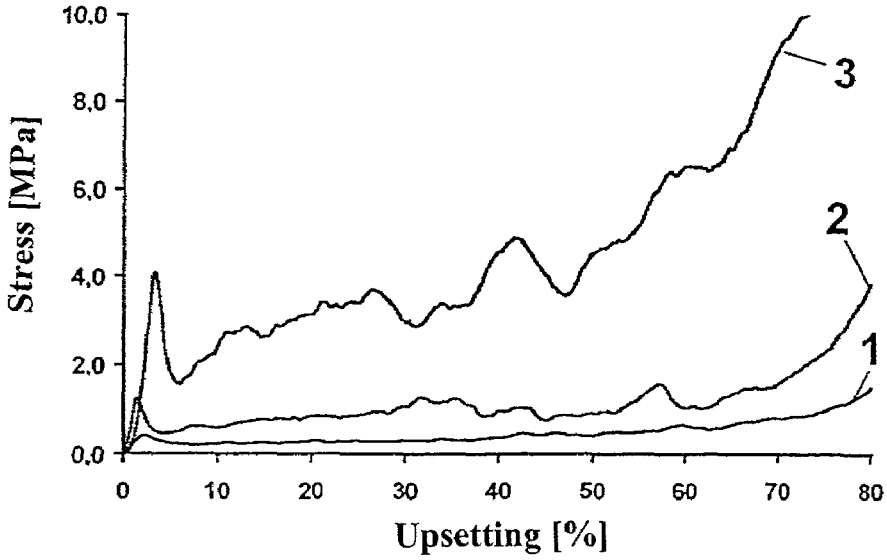
FIG. 3 is a graphic representation of the degree of upsetting as a function of the upsetting stress of molded parts.

The stress as a function of the upsetting deformation is shown in a comparative way in FIG. 3 by means of the test results of three molded parts. The structure of lightweight molded parts 1 and 2 with a volume weight of 0.091 $gcm^{-3}$ and 0.114 $gcm^{-3}$ was according to the invention, whereas comparison part 3 showed a bimodal distribution of the dimension of the voids with material concentrations in the nodes of the foam walls. From the upsetting curves of parts 1 and 2 an extremely low compaction of the same can be seen up to an upsetting degree of approx. 70%. Comparison part 3 shows a distinct compaction of the material up to an upsetting degree of approx. 45%, which continues to rise even further from this value on. This suggests an effect of the bimodal distribution of the void dimensions.

Figure 4:
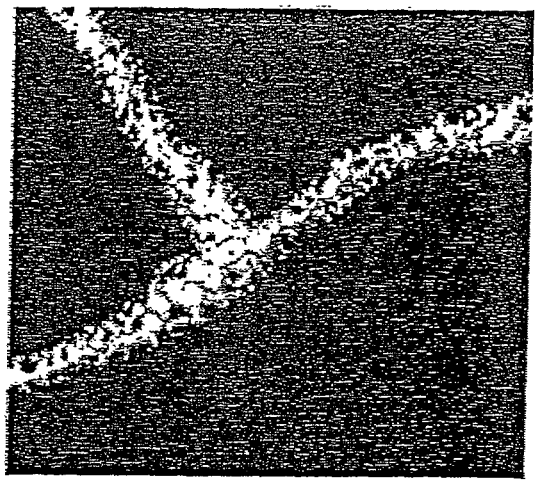
FIG. 4 shows sectional views A, B, C of nodal forms in the foam walls.
Figure 4:
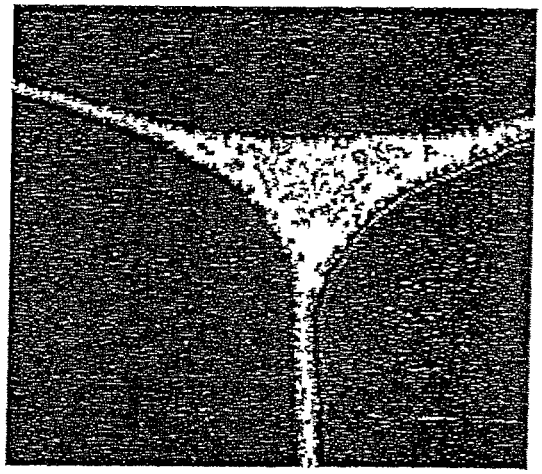
Figure 4:
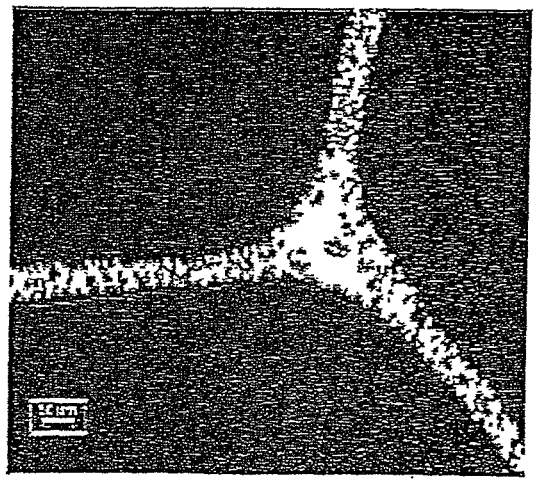

FIG. 4 shows nodal forms in the foam wall of lightweight parts on the basis of sectional views.

View A shows a sharp-edged nodal formation of the wall between three cells. Such nodes have a tendency to form premature cracks and breaks in the connecting area.

A thickened wall node can be seen from view B. This nodal formation leads to an increased specific gravity and an unfavorable distribution of the force components when the part is subjected to an upsetting pressure.

View C shows a node with wall parts, wherein both the thickness of the walls and the nodal mass are favorably formed with regard to a high upsetting deformation with low compaction of the part at high upsetting degrees.

Figure 5:
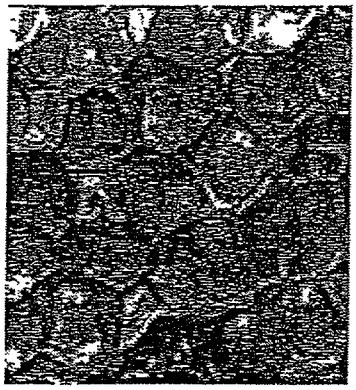
FIG. 5 shows plan views A, B, C of foam parts with different volumetric density.
Figure 5:
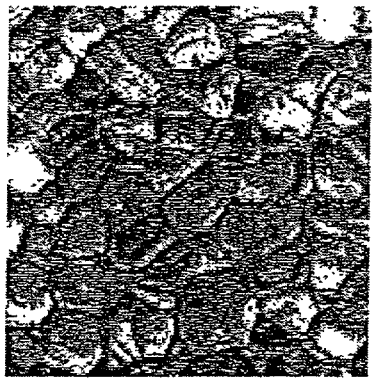
Figure 5:
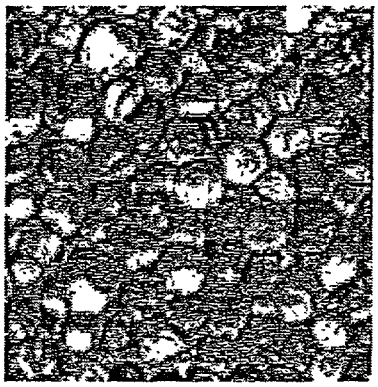

FIG. 5 shows metal foam parts without thickening formed according to the invention in plan view, wherein the gas was introduced through feed pipes projecting inwardly into the melt with different release parameters for each of the bubbles. A monomodal distribution of the respective dimensions of the gas bubbles can be seen. The part according to View A has a specific gravity of 0.1 $gcm^{-3}$, those according to View B and View C have specific gravities of 0.2 $gcm^{-3}$ and 0.4 $gcm^{-3}$, respectively.

Computer tomography data can be used to calculate values of the local density (density mapping). An averaging process for calculating the local densities makes it possible to determine the material distribution between the averaging volumes. Diagrams of the calculated density values of tests can provide information on the homogeneity of a lightweight molded part.

Figure 6:
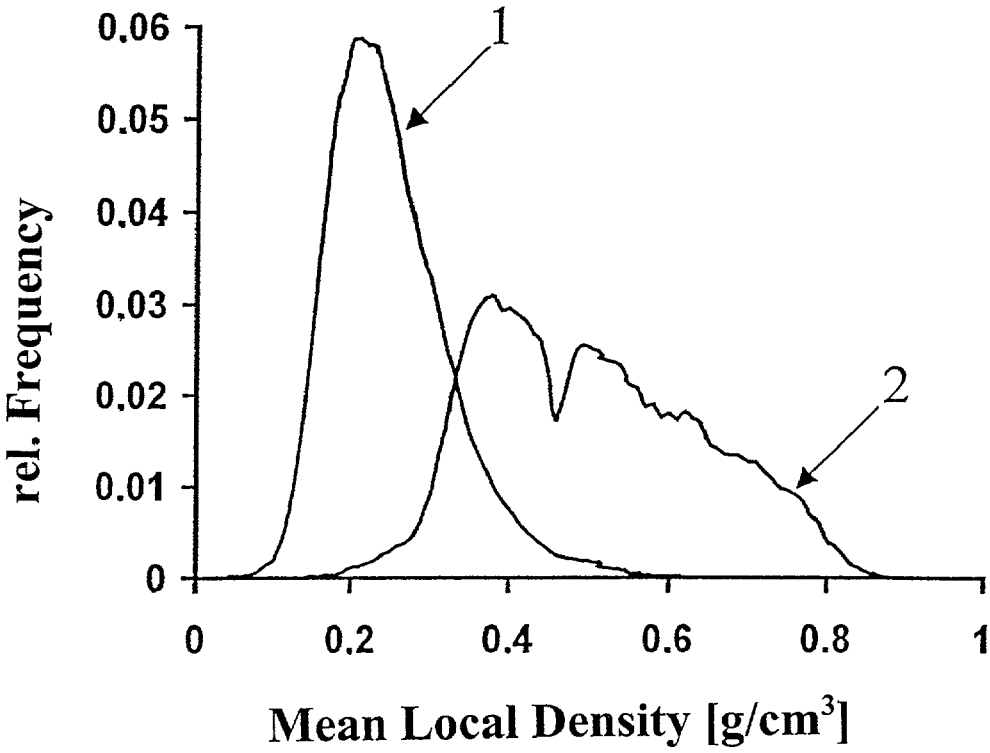
FIG. 6 is a graphic representation of the mean local density of a foam part according to the invention and a comparison foam part.

FIG. 6 shows the relative frequency of the mean local density in a molded part according to the invention (labeled 1) and in a comparison part (2) calculated according to a computer tomography process. At 0.22 $gcm^{-3}$ the mean local density of part 1 has a narrow frequency maximum, which indicates a monomodal distribution of the dimension of the voids and a narrow range of the proportionate maximum longitudinal extensions of the same. In contrast, the multimodal comparison part is characterized by a broad progression of the mean local density values, showing a clear drop.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for producing a lightweight molded part, comprising (a) introducing a gas into a particle-containing, molten metal to produce a free-flowing metal foam having voids therein, said voids having a monomodal distribution of their dimensions, (b) at least partially introducing the metal foam into a casting die and compressing it therein under essentially all-round pressure, and (c) allowing the liquid phase to solidify.

2. The process of claim 1, wherein the gas is introduced through at least one feed pipe which projects inwardly into the molten metal.

3. The process of claim 2, wherein the gas comprises a mixture of at least two gases.

4. The process of claim 1, wherein the casting die has interior dimensions corresponding to desired dimensions of the molded part.

5. The process of claim 1, wherein compressing the metal foam results in walls of metal enclosing the voids having planar areas in at least parts thereof.

6. The process of claim 1, wherein in the solidified metal foam a proportionate maximum longitudinal extension of the voids is in the range of 1 to 30 mm.

7. The process of claim 6, wherein a ratio of maximum longitudinal extensions of two different voids for at least 20 pairs on the average is lower than 45.

8. The process of claim 7, wherein said ratio is lower than 15.

9. The process of claim 1, wherein the metal comprises a light metal.

10. The process of claim 1, wherein the metal comprises at least one of aluminum and an aluminum alloy.

11. The process of claim 9, wherein the particles comprise particles of SiC, $Al_2O_3$, intermetallic phases and mixtures thereof.

12. The process of claim 1, wherein the particles have a size of 1 to 50 μm.

13. The process of claim 11, wherein the particles have a size of 3 to 20 μm.

14. The process of claim 1, wherein a volume fraction of the particles in the metal is 10 vol % to 50 vol %.

15. The process of claim 13, wherein a volume fraction of the particles in the metal is 15 vol % to 30 vol %.

16. The process of claim 1, wherein the metal foam has a density of less than 1.05 $g/cm^3$.

17. The process of claim 16, wherein the metal foam has a density of less than 0.7 $gg/cm^3$

* * * * *